US012228360B2

(12) United States Patent
Bender

(10) Patent No.: US 12,228,360 B2
(45) Date of Patent: Feb. 18, 2025

(54) FIREARM COMPENSATOR

(71) Applicant: In Ovation LLC, Vadnais Heights, MN (US)

(72) Inventor: Terrence D. Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 17/901,814

(22) Filed: Sep. 1, 2022

(65) Prior Publication Data

US 2023/0168058 A1 Jun. 1, 2023

Related U.S. Application Data

(60) Provisional application No. 63/239,938, filed on Sep. 1, 2021.

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS 785,972 A * 3/1905 McClean ..... F41A 21/36 89/14.3
785,973 A * 3/1905 McClean ..... F41A 21/36 89/14.3
786,230 A * 3/1905 McClean ..... F41A 21/36 89/14.3
811,595 A 2/1906 Hamelin
1,242,890 A 10/1917 Sheppard
1,413,903 A 4/1922 Czegka
1,527,585 A 2/1925 Hamilton et al.
2,212,686 A * 8/1940 Hughes ..... F41A 21/36 89/14.3
3,115,060 A * 12/1963 Ashbrook ..... F41A 21/36 89/14.3
3,141,376 A * 7/1964 Chinn ..... F41A 21/36 89/14.3

(Continued)

FOREIGN PATENT DOCUMENTS

CN 106871719 A 6/2017
DE 3430521 A1 2/1986

(Continued)

OTHER PUBLICATIONS

Best 3—Gen Rifle Compensators [2019], PewPewTactical.com, May 27, 2017, Written by Travis Pike, [online], [site visited Mar. 26, 2019]. (Year: 2017).

(Continued)

*Primary Examiner* — Samir Abdosh
(74) *Attorney, Agent, or Firm* — Laabs Intellectual Property

(57) ABSTRACT

In some embodiments, a firearm muzzle device comprises a body comprising an internal passageway comprising a first portion and a second portion. The first portion comprises a larger cross-sectional area than the second portion. A plurality of first vents are each in fluid communication with the first portion. A plurality of second vents are each in fluid communication with the second portion.

17 Claims, 6 Drawing Sheets

(56) References Cited

U.S. PATENT DOCUMENTS

| | | | | |
|---|---|---|---|---|
| 4,322,999 | A | 4/1982 | Aston | |
| D279,812 | S | 7/1985 | Cellini | |
| 4,545,285 | A | 10/1985 | McLain | |
| 4,685,534 | A | 8/1987 | Burstein et al. | |
| 4,691,614 | A * | 9/1987 | Leffel | F41A 21/36 89/14.3 |
| D296,350 | S | 6/1988 | Cellini | |
| 4,869,151 | A | 9/1989 | Chahin | |
| 4,879,942 | A * | 11/1989 | Cave | F41A 21/36 89/14.3 |
| 4,930,396 | A * | 6/1990 | Johnson | F41A 21/36 89/14.3 |
| 5,020,416 | A | 6/1991 | Tripp | |
| 5,036,747 | A | 8/1991 | McClain, III | |
| 5,092,223 | A | 3/1992 | Hudson | |
| 5,119,716 | A | 6/1992 | Bartolles | |
| 5,367,940 | A | 11/1994 | Taylor | |
| 5,631,438 | A | 5/1997 | Martel | |
| 5,811,714 | A | 9/1998 | Hull et al. | |
| 5,814,757 | A | 9/1998 | Buss | |
| 6,578,462 | B1 | 6/2003 | Franchino et al. | |
| D515,169 | S | 2/2006 | Bounds | |
| 7,143,680 | B2 | 12/2006 | Bender | |
| 7,854,297 | B2 | 12/2010 | Scanlon et al. | |
| 8,087,337 | B1 * | 1/2012 | Cary | F41A 21/36 89/14.3 |
| D666,687 | S | 9/2012 | Nierenberg | |
| 8,342,071 | B2 * | 1/2013 | Hortobagyi | F41A 21/34 89/14.3 |
| 8,522,662 | B2 | 9/2013 | Presz, Jr. et al. | |
| D692,086 | S | 10/2013 | Nierenberg | |
| D694,355 | S | 11/2013 | Hormann | |
| 8,695,475 | B2 | 4/2014 | Schneider | |
| D711,491 | S | 8/2014 | Nierenberg | |
| D716,408 | S | 10/2014 | Oglesby | |
| D729,894 | S | 5/2015 | DeLuca | |
| D737,922 | S | 9/2015 | Pace | |
| D746,937 | S * | 1/2016 | Larson, Jr. | D22/108 |
| D747,429 | S * | 1/2016 | Larson, Jr. | D22/108 |
| 9,228,789 | B1 | 1/2016 | Oglesby | |
| D763,395 | S | 8/2016 | Joplin | |
| D765,209 | S * | 8/2016 | Sui | D22/108 |
| D765,210 | S * | 8/2016 | Sui | D22/108 |
| D767,074 | S | 9/2016 | Sui | |
| D767,076 | S | 9/2016 | Bebee | |
| D779,019 | S | 2/2017 | ArnedoVera et al. | |
| D783,758 | S * | 4/2017 | Clark | D22/108 |
| D787,621 | S | 5/2017 | Larson, Jr. | |
| 9,739,296 | B2 | 8/2017 | Schlosser et al. | |
| 9,772,157 | B2 | 9/2017 | Yoakam et al. | |
| D807,980 | S | 1/2018 | Frederickson | |
| D835,226 | S | 12/2018 | Haman | |
| D842,960 | S | 3/2019 | Liu | |
| D868,197 | S | 11/2019 | Bender | |
| 11,118,857 | B2 | 9/2021 | Griffin et al. | |
| 11,480,405 | B2 | 10/2022 | Bender | |
| 2003/0106416 | A1 | 6/2003 | Vais | |
| 2003/0106417 | A1 | 6/2003 | Vais | |
| 2003/0154849 | A1 | 8/2003 | Breuer et al. | |
| 2004/0244571 | A1 | 12/2004 | Bender et al. | |
| 2005/0188829 | A1 | 9/2005 | Hanslick et al. | |
| 2010/0224054 | A1 | 9/2010 | Langner | |
| 2012/0180352 | A1 | 7/2012 | Addis | |
| 2013/0227871 | A1 * | 9/2013 | Stone | F41A 21/30 42/76.1 |
| 2015/0308778 | A1 * | 10/2015 | Vossler | F41A 21/34 89/14.3 |
| 2016/0169606 | A1 | 6/2016 | Joplin et al. | |
| 2021/0164748 | A1 * | 6/2021 | Griffitts | F41A 21/36 |
| 2023/0032661 | A1 * | 2/2023 | Geissele | F41A 21/36 |

FOREIGN PATENT DOCUMENTS

| | | | |
|---|---|---|---|
| GB | 614464 | A | 12/1948 |
| RU | 2646980 | C1 | 3/2018 |
| WO | 2016205838 | A1 | 12/2016 |

OTHER PUBLICATIONS

Dissident Arms 4-Port Phoenix Compensator, DissidentArms.com, [online], [site visited Mar. 26, 2019]. (Year: 2019).

Muzzle Brakes, Compensators, and Flash Hiders, Range365.com, by T. Logan Metesh, Oct. 10, 2018, [online], [site visited Mar. 26, 2019]. (Year: 2018).

Warrior East 19—Mad Minute Suppressors, Jul. 15, 2019, Solider Systems, p. 1 (Year: 2019).

* cited by examiner

FIREARM COMPENSATOR

CROSS-REFERENCE TO RELATED APPLICATIONS

This application claims the benefit of U.S. Patent Application No. 63/239,938, filed Sep. 1, 2021, the entire content of which is hereby incorporated herein by reference.

BACKGROUND OF THE INVENTION

This invention relates generally to firearms and more specifically to muzzle devices for firearms.

Firearm muzzle devices are generally known in the art. A muzzle device can provide various benefits such as reduction of visible flash at target, reduction of audible report at target, reduction of recoil felt by the firearm operator, etc.

There remains a need for novel firearm muzzle devices that provide benefits over prior designs.

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm muzzle device comprises a body comprising an internal passageway comprising a first portion and a second portion. The first portion comprises a larger cross-sectional area than the second portion. A plurality of first vents are each in fluid communication with the first portion. A plurality of second vents are each in fluid communication with the second portion.

In some embodiments, the passageway comprises a tapered portion oriented between the first portion and the second portion.

In some embodiments, each first vent comprises a slot.

In some embodiments, each first vent comprises a tube.

In some embodiments, a cross-sectional area of the first portion is at least 3 times a cross-sectional area of the second portion.

In some embodiments, a total cross-sectional area of the plurality of first vents is greater than a cross-sectional area of the first portion.

In some embodiments, a total cross-sectional area of the plurality of second vents is greater than a total cross-sectional area of the plurality of first vents.

In some embodiments, a total cross-sectional area of the plurality of second vents is at least 1.5 times a total cross-sectional area of the plurality of first vents.

In some embodiments, the internal passageway comprises a transition surface oriented between the first portion and the second portion. In some embodiments, the transition surface is not in direct fluid communication with the first vents or the second vents.

In some embodiments, each first vent comprises a longitudinal axis oriented at an angle to a central axis of the internal passageway.

In some embodiments, each second vent comprises a longitudinal axis oriented at an angle to the central axis of the internal passageway.

In some embodiments, the longitudinal axis of a first vent is parallel to a longitudinal axis of a second vent.

In some embodiments, the longitudinal axis of each first vent is parallel to a longitudinal axis of a second vent.

In some embodiments, the plurality of second vents comprises a first row of second vents and a second row of second vents. In some embodiments, a cross-sectional area of each second vent in the first row is less than a cross-sectional area of each second vent in the second row.

In some embodiments, the device is symmetrical across a longitudinal midplane.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
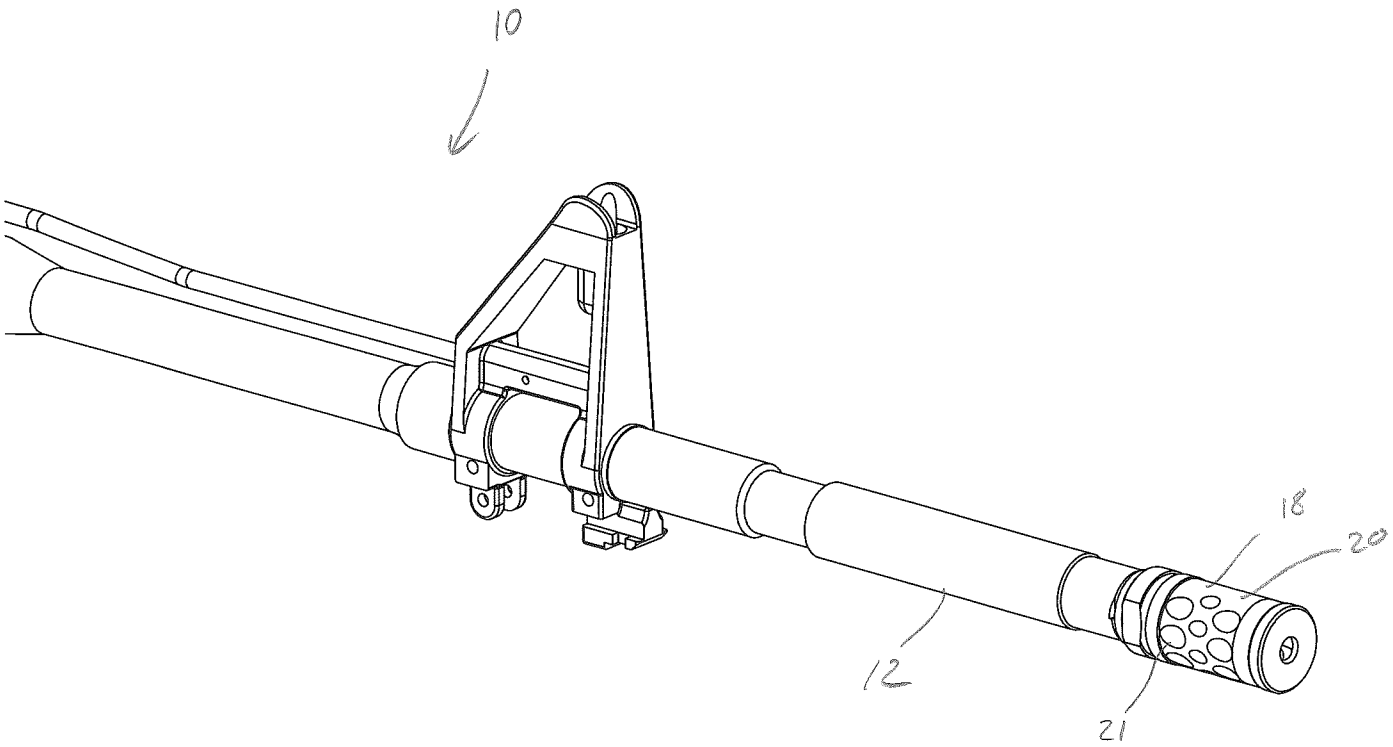
FIG. 1 shows an embodiment of a muzzle device on a firearm.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a firearm 10 comprising an embodiment of a compensator 20. In some embodiments, a firearm 10 comprises a muzzle device 18. In some embodiments, the firearm 10 comprises a barrel 12 and the muzzle device 18 is oriented at the end of the barrel 12. In some embodiments, the muzzle device 18 is attached to the barrel 12. In some embodiments, the muzzle device 18 is supported by the barrel 12. In some embodiments, the muzzle device 18 comprises a compensator 20 arranged to control propellant gasses exiting the barrel 12.

Figure 2:
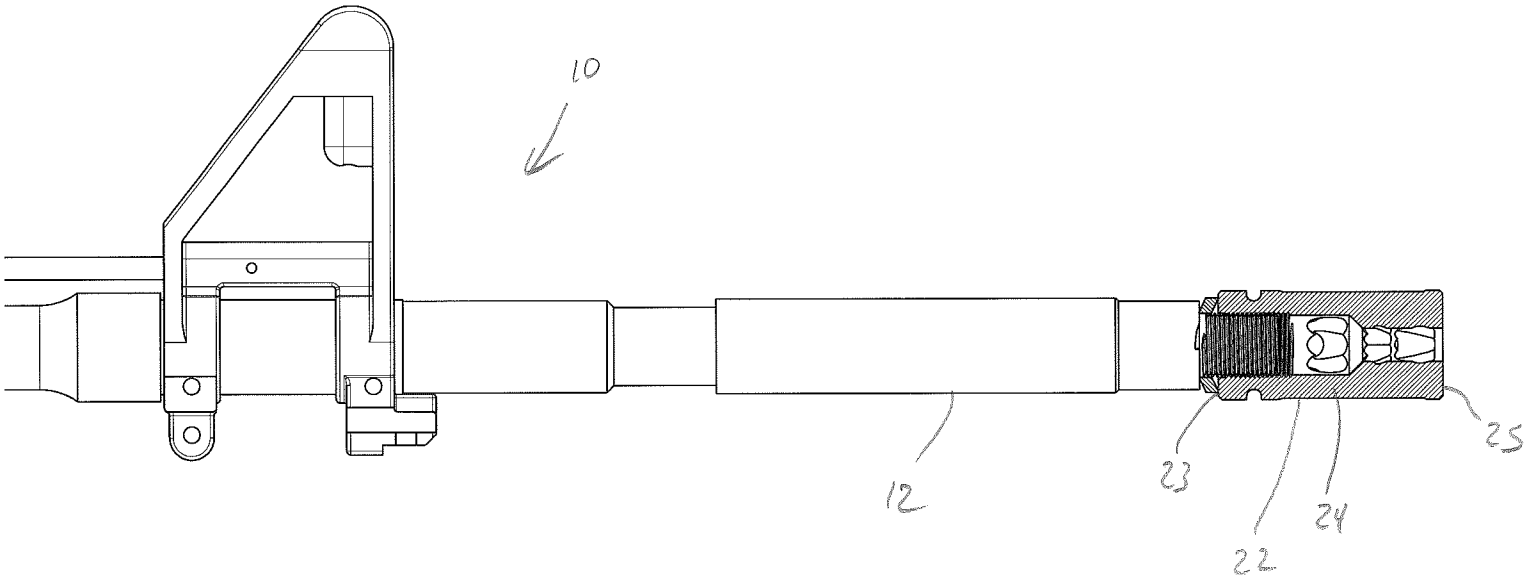
FIG. 2 shows a cross-sectional view of the muzzle device of FIG. 1.
Figure 3:
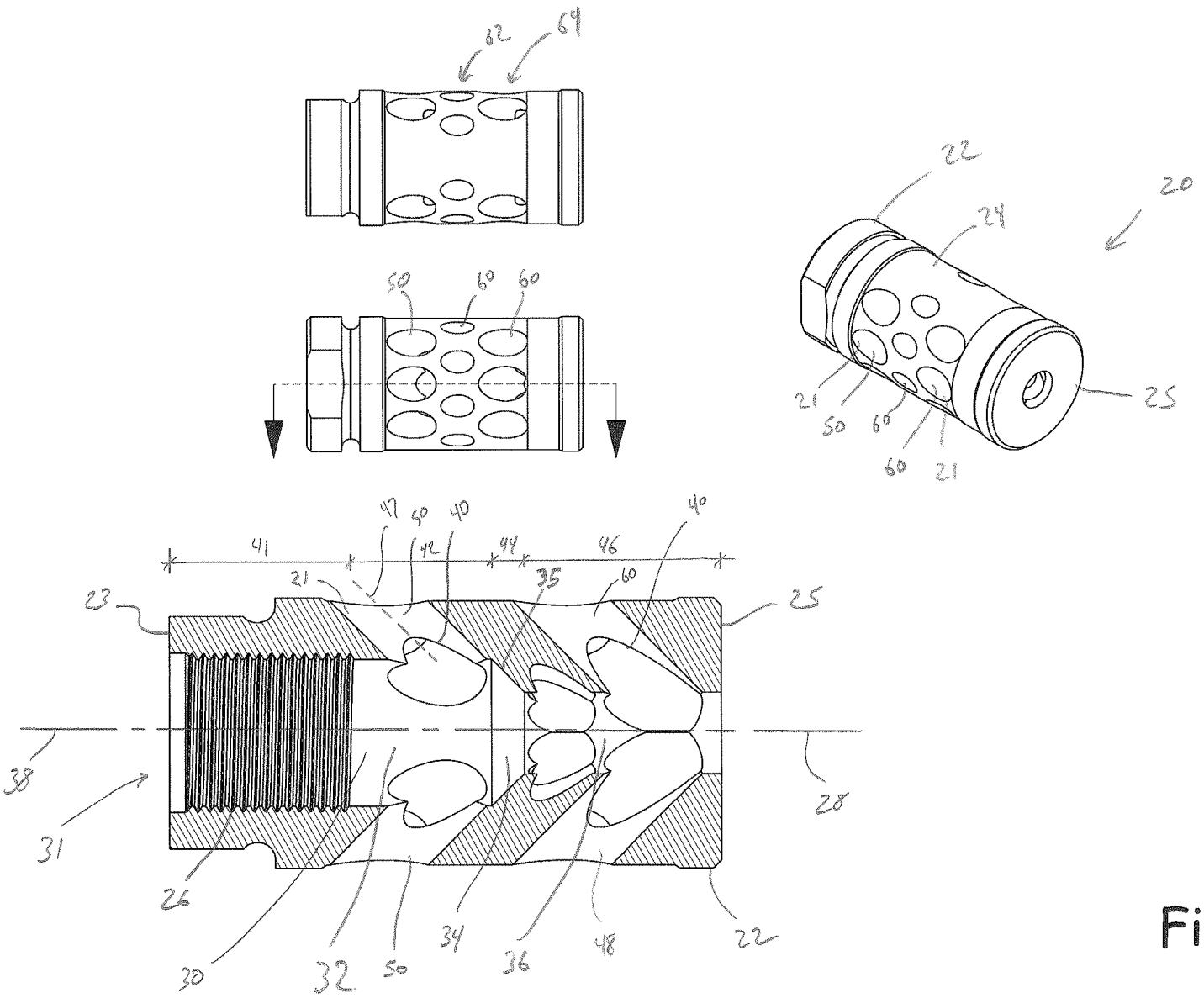
FIG. 3 shows several views of the embodiment of a muzzle device shown in FIG. 1.
Figure 4:
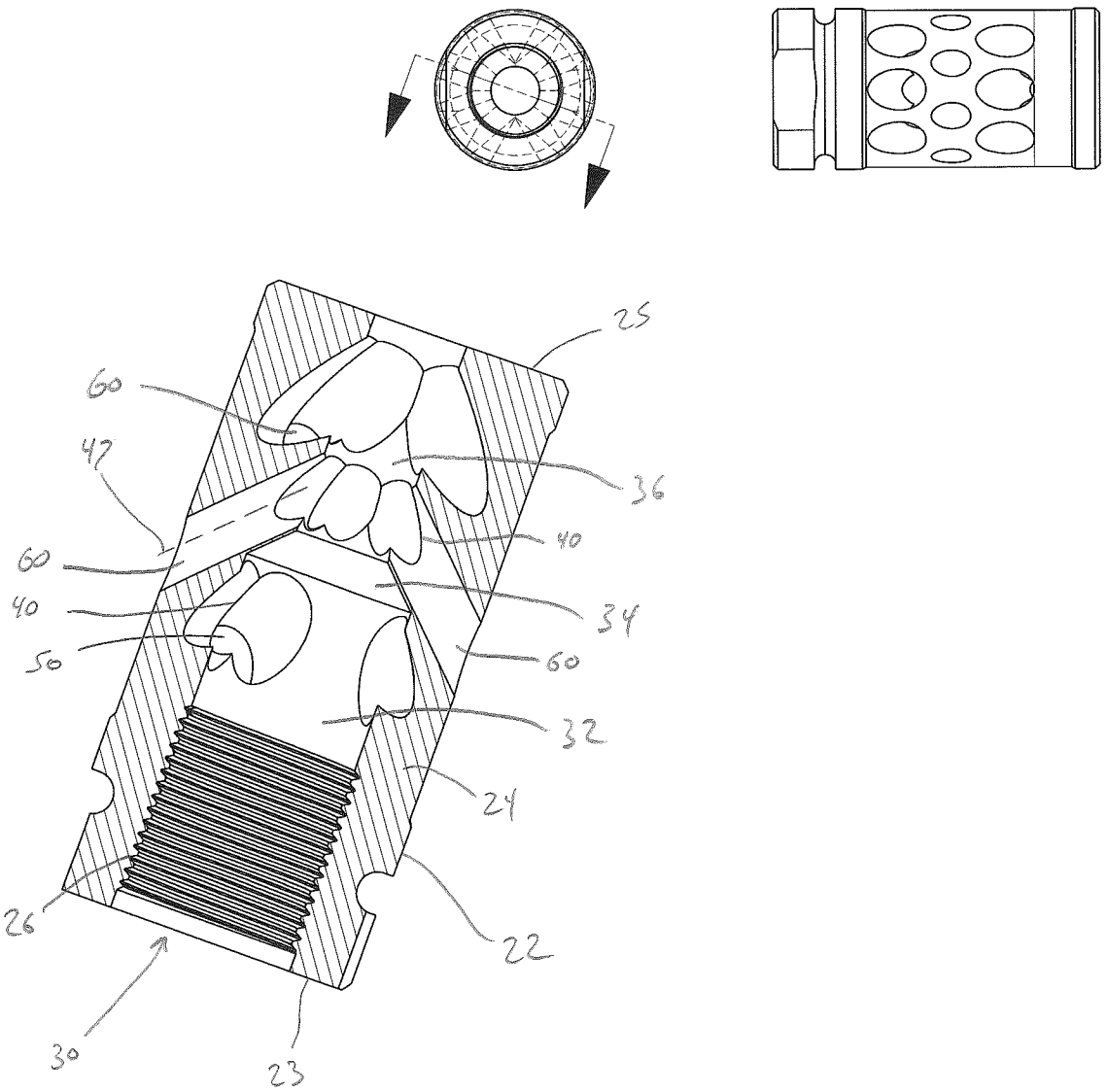
FIG. 4 shows additional views of the embodiment of a muzzle device shown in FIG. 1.

FIG. 2 shows a cross-sectional view of the embodiment of a compensator 20 shown in FIG. 1. FIGS. 3 and 4 show additional views of the embodiment of a compensator 20 shown in FIG. 1, including another cross-sectional view taken along a different axis.

Desirably, a compensator 20 comprises a body 22. In some embodiments, the compensator 20 comprises an internal passageway 30 through the body 22. In some embodiments, the passageway 30 comprises a bore 31. In some embodiments, the internal passageway 30 extends from a first end 23 of the body 22 to a second end 25. In some embodiments, the body 22 comprises a sidewall 24 that surrounds the internal passageway 30. In some embodiments, a central axis 28 of the body 22 is colinear with a central axis 38 of the passageway 30.

In some embodiments, the body 22 comprises helical threads 38, for example arranged to engage a portion of a firearm 10, such as a barrel 12. In some embodiments, the threads 38 comprise a surface of the sidewall 24. In some embodiments, the threads 38 are located near the first end 23 of the body 22.

In some embodiments, the body 22 comprises a mounting portion that occupies an engagement length portion 41. In some embodiments, the engagement length portion 41 will overlap a portion of a firearm 10, such as a barrel 12.

In some embodiments, the passageway 30 comprises a first portion 32 and a second portion 36. In some embodiments, the first portion 32 and second portion 26 are arranged to receive propellant gasses, for example from a barrel 12. In some embodiments, the first portion 32 comprises a first length portion 42 of the body 22. In some embodiments, the second portion 36 comprises a second length portion 46 of the body 22. In some embodiments, a cross-sectional area of the first portion 32 is larger than a cross-sectional area of the second portion 36. In some embodiments, the passageway 30 can comprise any suitable cross-sectional shape. In some embodiments, the passageway 30 comprises a circular cross-sectional shape. In some embodiments, a diameter of the first portion 32 is larger than a diameter of the second portion 36. Thus, in some embodiments, a cross-sectional size of the passageway 30 is reduced as the body 22 is traversed in the direction of bullet travel (for example traveling from the first end 23 toward the second end 25).

In some embodiments, the second portion 36 can have any suitable cross-sectional size. In some embodiments, the second portion 36 can be made as small as possible, for example being safely larger than a bullet expected to traverse the passageway 30. In some embodiments, a cross-sectional area of the second portion 36 is substantially constant.

In some embodiments, the first portion 32 can have any suitable cross-sectional size. In some embodiments, a cross-sectional area of the first portion 32 is at least 1.2 times a cross-sectional area of the second portion 36. In some embodiments, a cross-sectional area of the first portion 32 is at least 2 times a cross-sectional area of the second portion 36. In some embodiments, a cross-sectional area of the first portion 32 is at least 3 times a cross-sectional area of the second portion 36. In some embodiments, a cross-sectional area of the first portion 32 is substantially constant. In some embodiments, an inner diameter of the first portion 32 is approximately equal to a thread diameter of the threads 26.

In some embodiments, the body 22 comprises a transition surface 34 oriented between the first portion 32 and the second portion 36. In some embodiments, a transition surface 34 occupies an intermediate length portion 44 of the body 22 oriented between the first length portion 42 and the second length portion 46. In some embodiments, the transition surface 34 can have any suitable shape. In some embodiments, the transition surface 34 is conical. In some embodiments, the transition surface 34 comprises curvature. In some embodiments, the transition surface 34 is oriented at an angle to the central axis 38.

In some embodiments, a compensator 20 comprises a plurality of vents 21. In some embodiments, a vent 21 comprises an aperture extending through the sidewall 24 of the body 22. In some embodiments, a vent 21 provides fluid communication between the passageway 30 and the outside airspace surrounding the body 22. In some embodiments, a port 40 comprises the opening between the passageway 30 and the vent 21.

In some embodiments, an axis 47 of a vent 21 is oriented at an angle to the central axis 28. In various embodiments, an axis 47 of a vent 21 can be oriented at any suitable angle to the central axis 28, for example ranging from greater than 1 degree to 90 degrees. In some embodiments, an axis 47 of a vent 21 comprises its central longitudinal axis.

In some embodiments, each vent 21 of a compensator 20 is oriented at a common angle to the central axis 28.

In some embodiments, a vent 21 comprises a vent tube 48. In some embodiments, a vent tube 48 comprises a constant cross-sectional shape. In some embodiments, a vent tube 48 comprises a circular cross-sectional shape. In some embodiments, a vent tube 48 comprises a constant cross-sectional area. An axis 47 of a vent tube can be oriented at any suitable angle to the central axis 28.

In some embodiments, a compensator 20 comprises a plurality of first vents 50. In some embodiments, each first vent 50 is in fluid communication with the first portion 32 of the passageway 30. In some embodiments, the first vents 50 are oriented in the first length portion 42. FIGS. 3 and 4 show an embodiment of a compensator 20 comprising six first vents 50. In some embodiments, a plurality of the first vents 50 are aligned with one another along the length of the body 22. In some embodiments, all the first vents 50 are aligned with one another along the length of the body 22.

In some embodiments, each first vent 50 comprises a port 40 in fluid communication with the first portion 32 of the passageway 30.

In some embodiments, a total cross-sectional area of all the first vents 50 is greater than the cross-sectional area of the first portion 32 of the passageway 30.

In some embodiments, an axis 47 of each first vent 50 is oriented at a common angle to the central axis 28.

In some embodiments, a compensator 20 comprises a plurality of second vents 60. In some embodiments, each second vent 60 is in fluid communication with the second portion 36 of the passageway 30. In some embodiments, a plurality of the second vents 60 are aligned with one another along the length of the body 22.

In some embodiments, a compensator 20 comprises a first row 62 of second vents 60 and a second row 64 of second vents 60. In some embodiments, the first row 62 is offset from the second row 64 along the length of the body 22. In some embodiments, the second row 64 is located closer to the second end 25 than the first row 62.

In some embodiments, each second vent 60 included in the first row 62 is aligned with one another along the length of the body 22. In some embodiments, each second vent 60 included in the first row 62 comprises a similar cross-sectional area. In some embodiments, an axis 47 of each second vent 60 included in the first row 62 is oriented at a common angle to the central axis 28.

In some embodiments, each second vent 60 included in the second row 64 is aligned with one another along the length of the body 22. In some embodiments, each second vent 60 included in the first row 62 comprises a similar cross-sectional area.

In some embodiments, a cross-sectional area of a vent 21 in the first row 62 is different from a cross-sectional area of a vent 21 in the second row 64. In some embodiments, the cross-sectional area of a vent 21 in the first row 62 is less than a cross-sectional area of a vent 21 in the second row 64.

In some embodiments, the first row 62 comprises a different number of vents 21 than the second row 64.

FIGS. 3 and 4 show an embodiment of a compensator 20 comprising eight second vents 60 arranged in a first row 62 and six second vents 60 arranged in a second row 64.

In some embodiments, each second vent 60 comprises a port 40 in fluid communication with the second portion 36 of the passageway 30.

In some embodiments, a total cross-sectional area of all the second vents 60 is greater than the cross-sectional area of the first portion 32 of the passageway 30.

In some embodiments, a total cross-sectional area of all the second vents 60 is greater than a total cross-sectional area of all the first vents 50.

In some embodiments, an axis 47 of each second vent 60 is oriented at a common angle to the central axis 28.

In some embodiments, the vents 21 are arranged in pairs that are located across the central axis 38 from one another. In some embodiments, each vent 21 is located across the central axis 38 from another vent 21. For example, in FIG. 3, the first vents 50 comprise three pairs of vents 21. The first row 62 of second vents 60 comprises four pairs of vents 21. The second row 64 of second vents 60 comprises three pairs of vents 21.

In some embodiments, each vent 21 in a given row comprises a longitudinal axis 47 that is nonparallel to the longitudinal axis 47 of all other vents 21 of that same row.

In some embodiments, no vent 21 is in direct fluid communication with a transition surface 34 of the passageway 30. For example, in some embodiments, no port 40 is located on the transition surface 34. In some embodiments, no port 40 is located in the intermediate length portion 44.

In some embodiments, no vent 21 extends through the second end 25 of the body 22.

In some embodiments, a ratio of cross-sectional area between the first portion 32 and second portion 36 of the passageway 30 is inversely proportional to a ratio of cross-sectional area between the first vents 50 and the second vents 60. For example, in some embodiments, a cross-sectional area of the first portion 32 is at least twice the cross-sectional area of the second portion 36 of the passageway 30, and the ratio is at least 2:1. Thus, the resulting inverse ratio between the first vents 50 and second vents 60 is 1:2, wherein the total cross-sectional area of the second vents 60 is at least twice the total cross-sectional area of the first vents 50.

Figure 5:
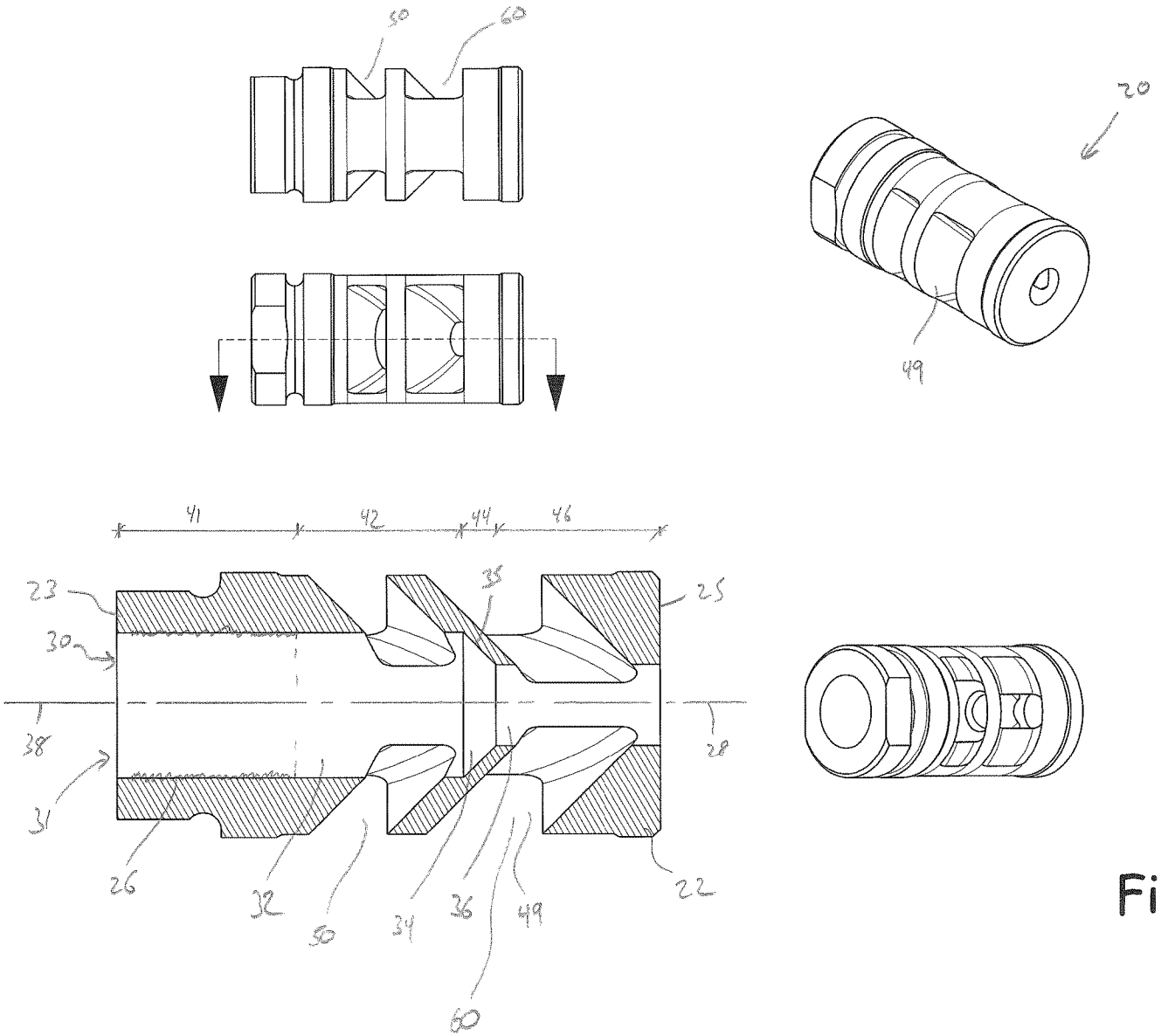
FIG. 5 shows another embodiment of a muzzle device.

FIG. 5 shows another embodiment of a compensator 20. In some embodiments, a vent 21 comprises a vent slot 49. In some embodiments, a vent slot 49 comprises an axis oriented at an angle to the central axis 28. In some embodiments, the first vents 50 can comprise vent slots 49 and the second vents 60 can comprise vent slots 49.

Figure 6:
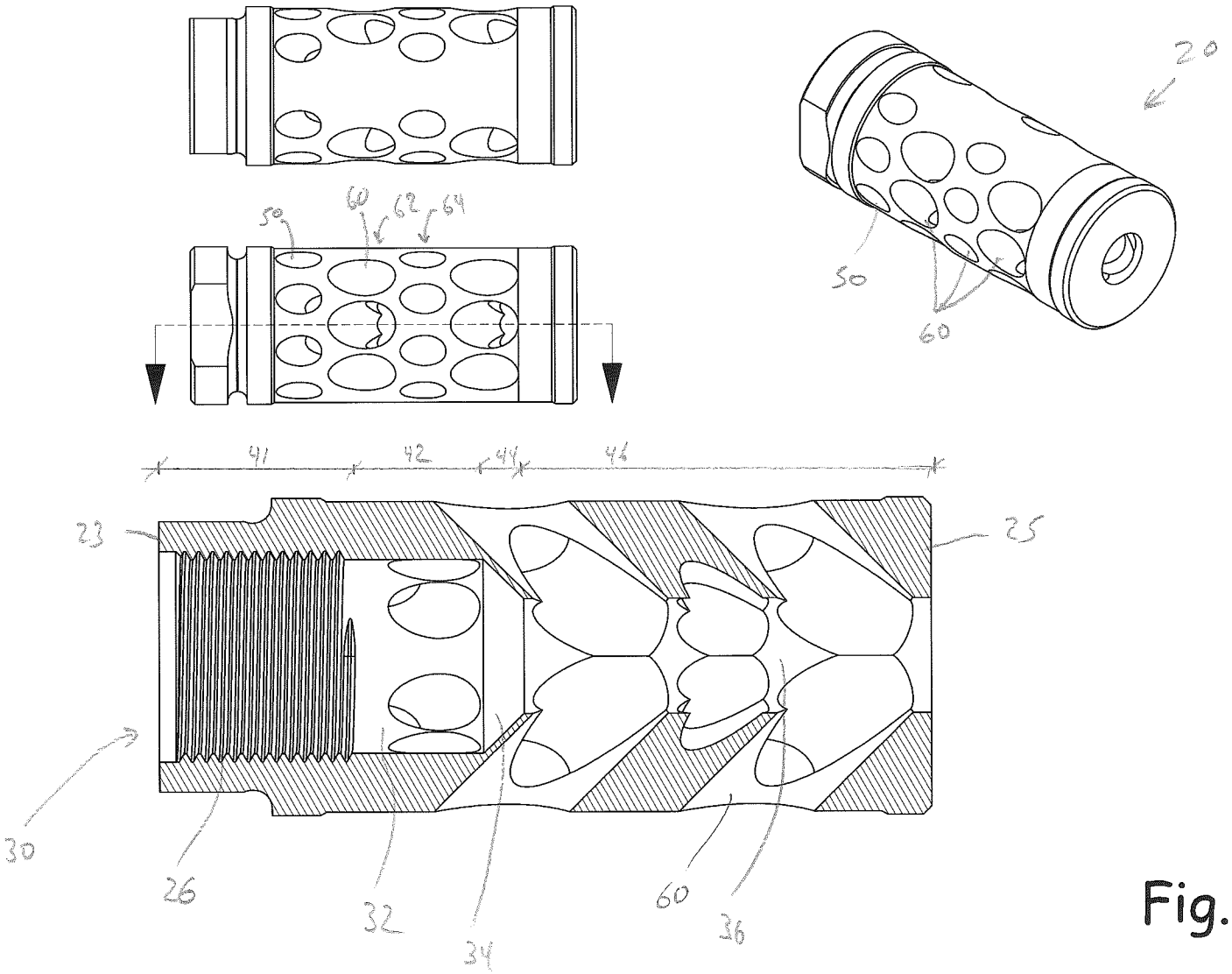
FIG. 6 shows another embodiment of a muzzle device.

FIG. 6 shows another embodiment of a compensator 20. In some embodiments, a length of the second portion 36 of the passageway 30 is at least 3 times the length of the first portion 32 of the passageway 30.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm muzzle device comprising:

a body comprising an internal passageway, a plurality of first vents and a plurality of second vents;

the internal passageway consisting of a first cylindrical portion, a tapered portion and a second cylindrical portion;

the first cylindrical portion comprising a larger cross-sectional area than the second cylindrical portion;

each first vent in fluid communication with the first cylindrical portion; and each second vent in fluid communication with the second cylindrical portion;

wherein no vent is in direct fluid communication with the tapered portion.

2. The device of claim 1, each first vent comprising a slot.

3. The device of claim 1, each first vent comprising a tube.

4. The device of claim 1, wherein a cross-sectional area of the first portion is at least 3 times a cross-sectional area of the second portion.

5. The device of claim 1, wherein a total cross-sectional area of the plurality of first vents is greater than a cross-sectional area of the first portion.

6. The device of claim 5, wherein a total cross-sectional area of the plurality of second vents is greater than the total cross-sectional area of the plurality of first vents.

7. The device of claim 1, wherein a total cross-sectional area of the plurality of second vents is greater than a total cross-sectional area of the plurality of first vents.

8. The device of claim 1, wherein a total cross-sectional area of the plurality of second vents is at least 1.5 times a total cross-sectional area of the plurality of first vents.

9. The device of claim 1, each first vent comprising a longitudinal axis oriented at a non-orthogonal angle to a central axis of the internal passageway.

10. The device of claim 9, each second vent comprising a longitudinal axis oriented at a non-orthogonal angle to the central axis of the internal passageway.

11. The device of claim 10, wherein the longitudinal axis of a first vent is parallel to a longitudinal axis of a second vent.

12. The device of claim 10, wherein the longitudinal axis of each first vent is parallel to a longitudinal axis of a second vent.

13. The device of claim 1, the plurality of second vents comprising a first row of second vents and a second row of second vents.

14. The device of claim 13, wherein a cross-sectional area of each second vent in the first row is less than a cross-sectional area of each second vent in the second row.

15. A firearm muzzle device comprising:

a body comprising an internal passageway comprising a central axis, a plurality of first vents and a plurality of second vents;

the internal passageway consisting of a first cylindrical portion, a tapered portion and a second cylindrical portion;

the first cylindrical portion comprising a larger cross-sectional area than the second cylindrical portion;

each first vent in fluid communication with the first cylindrical portion, each first vent comprising a longitudinal axis oriented at a non-orthogonal angle to the central axis; and each second vent in fluid communication with the second cylindrical portion, each second vent comprising a longitudinal axis oriented at a non-orthogonal angle to the central axis.

16. The device of claim 15, wherein a total cross-sectional area of the plurality of second vents is greater than a total cross-sectional area of the plurality of first vents.

17. The device of claim 15, wherein no vent is in direct fluid communication with the tapered portion.

* * * * *